US005652996A

United States Patent [19]

Moine et al.

[11] Patent Number: 5,652,996

[45] Date of Patent: Aug. 5, 1997

[54] HAND HELD CLEANER WITH SWIVELING NOZZLE

[75] Inventors: David W. Moine, North Canton; Greg A. Bilek, Doylestown; Leron R. Thomas, North Canton, all of Ohio

[73] Assignee: The Hoover Company, North Canton, Ohio

[21] Appl. No.: 565,835

[22] Filed: Dec. 1, 1995

[51] Int. Cl.[6] ..... A47L 5/26

[52] U.S. Cl. ..... 15/344; 15/328; 15/354

[58] Field of Search ..... 15/354, 356, 344, 15/328

[56] References Cited

U.S. PATENT DOCUMENTS

| | | | |
|---|---|---|---|
| 1,115,989 | 11/1914 | Thurman . | |
| 1,161,908 | 11/1915 | Tice . | |
| 1,318,881 | 10/1919 | Kelley . | |
| 1,355,553 | 10/1920 | Goughnour . | |
| 2,004,261 | 6/1935 | White . | |
| 2,054,975 | 9/1936 | Goldberg | 15/344 X |
| 2,194,386 | 3/1940 | Dunaway | 287/119 |
| 2,293,457 | 8/1942 | Dow . | |
| 2,395,430 | 2/1946 | Sloan . | |
| 2,730,480 | 1/1956 | Brown | 154/116 |
| 2,974,347 | 3/1961 | Seyfried | 15/356 |
| 3,189,933 | 6/1965 | Smith | 15/344 |
| 4,696,076 | 9/1987 | Ahlf et al. | 15/415.1 |
| 4,776,059 | 10/1988 | Worwag | 15/334 |
| 4,993,108 | 2/1991 | Genge et al. | 15/417 X |
| 5,008,973 | 4/1991 | Worwag | 15/417 X |
| 5,388,302 | 2/1995 | Sundaram et al. | 15/344 |

FOREIGN PATENT DOCUMENTS

| | | |
|---|---|---|
| 520534A1 | 12/1992 | European Pat. Off. . |
| 1093964 | 12/1960 | Germany . |

*Primary Examiner*—Chris K. Moore

*Attorney, Agent, or Firm*—A. Burgess Lowe; Richardson B. Farley

[57] ABSTRACT

A hand held cleaner is provided with a swiveling nozzle that moves from a position perpendicular to the cleaner body to a position of axial alignment with it. A series of stops are mounted on the swiveling nozzle and cleaner body to limit nozzle swing to these two positions. A reciprocable latch is mounted with the nozzle to engage, selectively, in one of a pair of latching apertures in the cleaner body to lockingly maintain the swiveling nozzle of its stopped positions. The agitator and agitator belt are offset from what would be considered their normal centered relationship to accommodate the swiveling action of the hand held cleaner nozzle.

11 Claims, 5 Drawing Sheets

FIG.-3
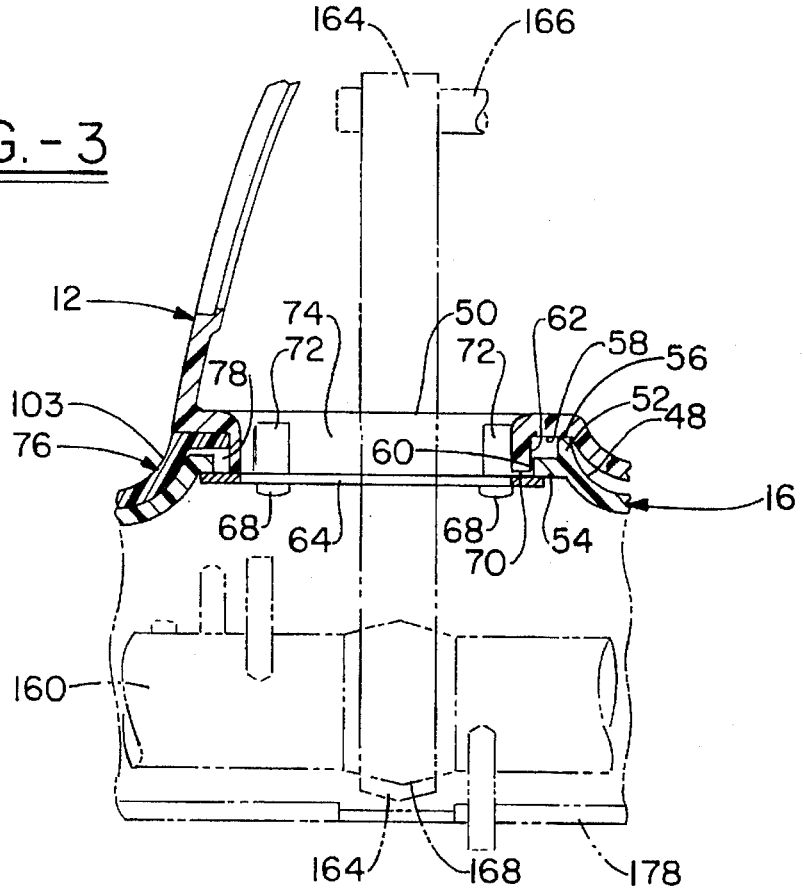
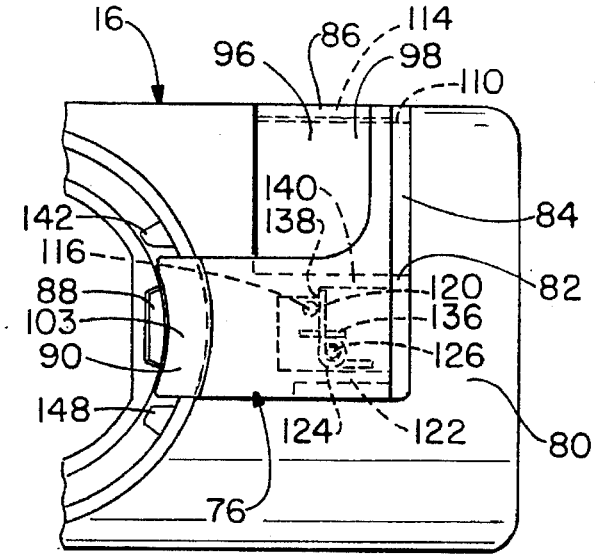
FIG.-9
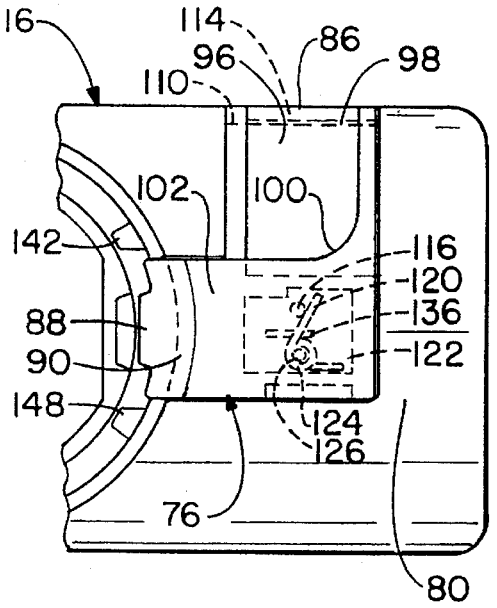
FIG.-10

HAND HELD CLEANER WITH SWIVELING NOZZLE

BACKGROUND OF THE INVENTION

1. Field of the Invention

This invention relates to hand held cleaners and, more particularly, relates to a hand held cleaner having a swiveling or turnable nozzle.

2. Description of the Prior Art

In the last decade, the sale of hand held cleaners has boomed, engendering many different competing models by a host of manufacturers, all in an attempt to secure a profitable niche in the marketplace. In this effort a variety of units have been produced, ranging from straight air, to driven agitator, to wet/dry pick up units, with some powered by house current and some by battery. Most of these hand held cleaners are advertised with some professed advantage over all the rest but all are somewhat cumbersome and appear to suffer from the statics arrangement of the nozzle and the resulting interference with the easy cleanability of corners and narrow spaces.

It is known in the prior art (U.S. Pat. No. 2,395,430, issued Feb. 26, 1946) to attempt to overcome this problem by providing easy nozzle accessibility to confined areas with the use of a swinging or swiveling nozzle that is capable of moving from the standardized nozzle position, essentially, at right angles to the main body of the hand held cleaner to a position parallel to and axially centered on this main body. But the hand held cleaner of this patent provides, for example, a latch that does not appear to be particularly secure or to meld itself into the general outline of the hand held cleaner in an ergonomic location, nor does the hand held cleaner of this patent offset the nozzle pivot to limit belt movement on the shaft nor is the agitator pulley offset to accommodates belt twist in the normal position of the nozzle nor does it provide a simplified, easily assembled latch and secure simplified pivot mounting for the nozzle.

Accordingly, it is an object of this invention to provide an improved and refined and, thereby, marketable hand held cleaner having the important attribute of a swivelable or swinging nozzle.

It is a further object of the invention to provide an improved latch for a swinging nozzle of a hand held cleaner.

It is an additional object of the invention to mount a latch to be utilized as a part of the locking mechanism for the swinging nozzle on the nozzle, itself.

It is a further object of the invention to make this latch axially reciprocal for ease of operation and secure positioning of the nozzle.

It is an additional object of the invention to provide an easily mountable pivot arrangement between the nozzle and the hand held cleaner which is both simple and secure.

It is a further object of the invention to offset the nozzle pivot for this hand held cleaner relative to the agitator axial center line to limit its stretch and wear and to eliminate slippage of the belt from its drive shaft.

It is a still further object of the invention to offset the belt pulley crown to insure proper belt tracking in its twisted position.

It is an even further object of the invention to provide the swinging nozzle of a hand held cleaner with an inexpensive, durable and easily manufactured nozzle pivot.

It is a final object of the invention to provide a novel hand held cleaner having a swivelable nozzle which is easily manufactured and use.

SUMMARY OF THE INVENTION

The invention comprehends a hand held cleaner main body including a motor driven agitator and suction fan which discharges into a rear removable cup that mounts a dirt filtering bag. A swivelable nozzle is pivotally mounted to the bottom of the main body on a generally vertical axis to swing or swivel from a standard nozzle position medially arrayed and perpendicular to the cleaner main body to a position 90° away from this standard position where the nozzle is axially aligned with the hand held cleaner main body.

The nozzle is pivotally mounted for this movement by being rotatably trapped by a steel ring screwingly mounted to a boss-like element on the bottom of the hand held cleaner main body. This steel ring overlaps, outwardly, an annular top lip on the nozzle. This mount also provides an effective seal between these two parts. The latch which positively positions the swingable nozzle relative to the hand held cleaner body is reciprocatorily mounted on the top side of the nozzle. It is resiliently biased by a torsion spring to latched position and includes an inner latch tab. It engages selectively in one of a pair of latch detents formed in an external periphery of the hand held cleaner boss-like element. The latch includes spring tabs which keep it engagedly mounted in a latch mounting recess on the top of the nozzle.

The nozzle pivot center is set back from the agitator center when speaking of the traditional nozzle position so that belt shifting on the motor drive shaft is minimized and belt loading is reduced for normal operation with the belt in the twisted condition. A preload on the belt is then required for its non-twisted axially parallel position of the nozzle but it is not objectionable. An offset is also provided for the location of the crown of the belt pulley so that it tracks more properly on the motor shaft in both positions of the nozzle.

BRIEF DESCRIPTION OF THE DRAWINGS

Reference may now be had to the accompanying Drawings for a better understanding of the invention, both as to its organization and function, with the illustration being only exemplary, and in which:

FIG. 3 is an enlarged elevational view of a portion of FIG. 1 illustrating the mounting arrangement as between the nozzle and the cleaner front housing of the hand held cleaner;

FIG. 9 is a partial top plan view of the nozzle showing the latch means in an engaged position;

FIG. 10 is a partial top view similar to FIG. 9 but showing the latch in a disengaged position.

DETAILED DESCRIPTION OF THE PREFERRED EMBODIMENTS

Figure 1:
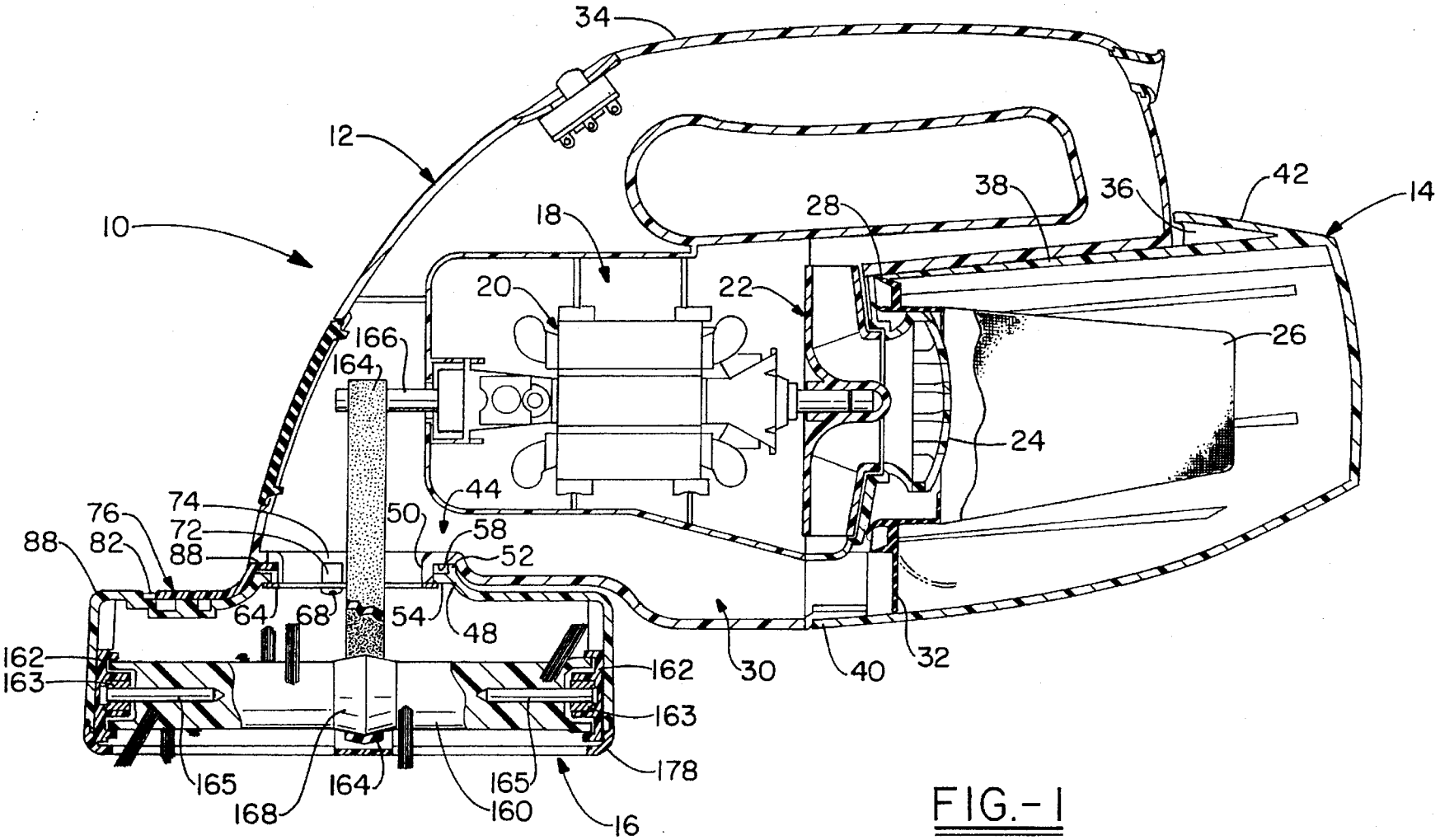
FIG. 1 is a side elevational view of a hand held cleaner illustrating various elements thereof in cross-section and others only diagrammatrically and showing a cleaner nozzle in an axially aligned position.
Figure 2:
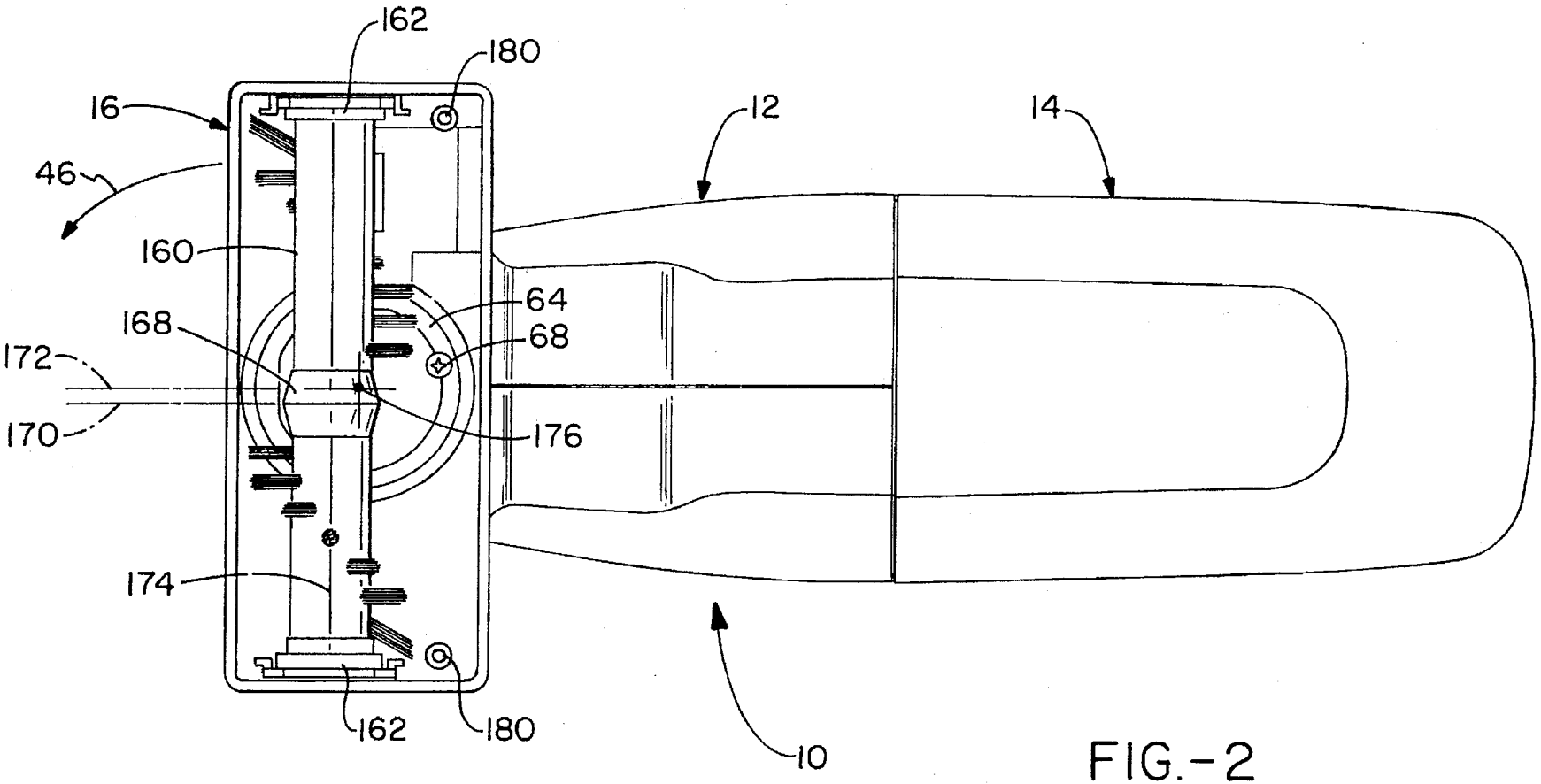
FIG. 2 is a bottom view of the cleaner shown in FIG. 1 but with the nozzle rotated 90° to an orthogonal alternative, conventional position.
Figure 4:
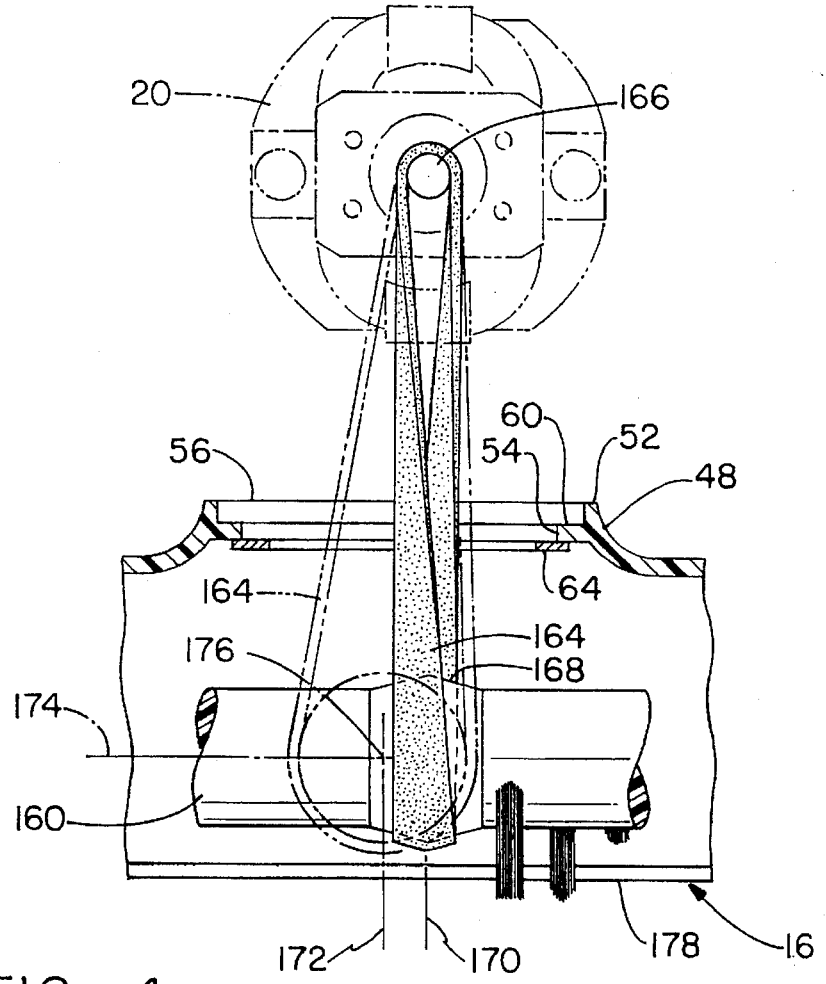
FIG. 4 is a front elevational view showing the cleaner drive means in the FIG. 1 position of the nozzle in ghost lines and, in full lines, the nozzle in partial cross-section with the drive means in the orthogonal alternative, conventional position.
Figure 5:
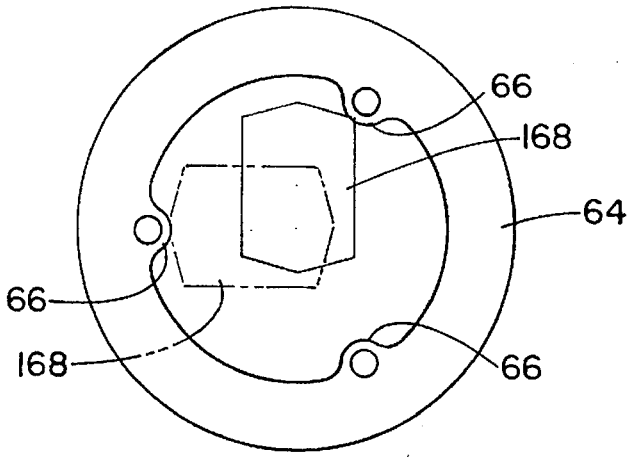
FIG. 5 diagrammatically illustrates the crown pulley and nozzle pivot offsets.

Referring to FIGS. 1–2, there is shown a hand held cleaner 10 having a front housing 12, a rearwardly extendly dirt cup 14 and a swiveling nozzle 16 attached to the front housing 12 at a bottom front portion of it.

The front housing 12 mounts a motor-fan system 18 therein including a forwardly disposed motor 20 and a fan 22 mounted to the rear of the motor 20. A vented suction baffle 24 permits air flow to be conveniently moved through it and discharged from it into the fan 22 and motor 20 and through louvers (not shown) of the sides of the front housing 12. A filter 26 of bag shape is sealingly lodged in the dirt cup 14 by an integral bag peripheral seal 28 that abuttingly and sealing engages an inside surface of dirt cup 14. Air flows through this filter to the fan 22 by being, first, moved by suction force through the suction nozzle 16 and then through a suction passageway 30 below the motor-fan system 18 to move into the dirt cup 14 by means of rearward deformation of a resilient flap 32 which opens directly into the dirt cup 14 behind the filter 26.

A handle 34 is integrally attached to the top side of the front housing and rearwardly overlaps the dirt cup 14 to be lodged in an axially extending pocket 36 formed in the top side of it. The handle 34 bottoms out on a flat 38 of the axially extending pocket 36 of dirt cup 14. The dirt cup 14 is telescopically mounted over the front housing 12 at their generally vertical jointure by an integral rim 40 on the dirt cup 14 that extends around it in all but the area where the pocket 36 is present. This rim, in assembled position of the dirt cup 14, overlaps portions of the front housing 12. The pocket 36, itself, is formed with overhanging short walls along its sides (not shown) and at its rear (rear wall 42) so that the handle portion of front housing 12 is also received telescopically within the dirt cup 14. These telescopic engagements provide practical functioning, working seals for the interior volume of dirt cup 14.

Now with reference to all the Figures, it can be seen that the nozzle 16 is pivotally mounted to front housing 12 by a pivot means 44. It permits the nozzle 16 to pivot from a position where its long axis is perpendicular to, generally, the long axis of the hand held cleaner 10 or to a position where these axes are approximately coaxial. Such movement is occasioned by pivotal turning of the swiveling nozzle in the direction indicated by the direction arrow 46 in FIG. 2 from the position shown in this Figure to the position shown in FIG. 1 and also reversely.

The pivot means 44 is formed, in part, on the swiveling nozzle by an upper, upwardly extending boss-like portion 48 on the swiveling nozzle 16 and, in part, by a lower, downwardly extending boss 50 on front housing 12. The upwardly extending boss-like portion 48 of the swiveling nozzle 16 includes an outer, integral, vertical, generally cylindrical rim 52 and an inner horizontal circular lip 54 spaced below the top of cylindrical rim 52. A top surface 56 of cylindrical rim 52 of swiveling nozzle 16 rides against an integral flat 58 formed around the front housing boss 50 while an inner cylindrical surface 60 of circular lip 54 of the boss-like portion 48 of swiveling nozzle 16 rides against an external cylindrical surface 62 of downwardly extending boss 50.

The nozzle upwardly extending boss-like portion 48 and, thereby, the swiveling nozzle 16 is maintained with the front housing 12 of hand held cleaner 10 by being held in an overlapping relations by a separate metal attaching ring 64. This ring has a series of three equally spaced, inwardly projecting lug portions 66, 66, 66 which receive attaching screws 68, 68, 68 that mount the attaching ring 64 abuttingly against a bottom surface 70 of front housing boss 50. The screws 68, 68, 68 are received upwardly in depending vertically extending screw mounting bosses 72, 72, 72, located on an interior surface 74 of boss 50. These bosses, in plan view, are shaped substantially as the lug portions 66 are in plan view.

The attaching ring 64, when in mounted position, has a ringlike configuration that places its inner diameter at the inner diameter of the boss 50 and an outer diameter that extends beyond the outer diameter of the boss 50 so as to partially overlap the lip 54 of swiveling nozzle boss-like portion 48 and, thereby, rotationally trap the swiveling nozzle 16 with the front housing 12.

The swiveling nozzle 16 is maintained in its two positions of adjustment by the use of latch 76, mounted with the swiveling nozzle 16, and a pair of latch receiving pockets 78, 78 formed in the downwardly extending boss 50 of the front housing 12.

The latch receiving pockets 78, 78 appear, in plan, as truncated, shallow segment shaped depressions formed in the outer cylindrical surface 62 of boss 50. These depressions extend in height (not shown) between the bottom surface 70 of downwardly extending boss 50 and the integral flat 58 formed on front housing 12.

The latch 76 is reciprocatorily mounted on a top surface 80 of swiveling nozzle 16 in a peripheral depression or pocket 82 formed therein. The latch 76 and its depression or pocket 82, when viewed from the top side of the swiveling nozzle 16, are right angled, with one non-axially extending leg 84 of the depression 82 of the swiveling nozzle 16 being wider than one leg 86 of the latch 76 that seats in it. This permits the latch 76 to move axially along the swiveling nozzle 16 within the pocket 82 (FIGS. 9 and 10) so that an inner latch catch 88 mounted integrally on an inner end of the other leg 90 of latch 76 may engage in one of the latch receiving pockets 78, 78.

Figure 11:
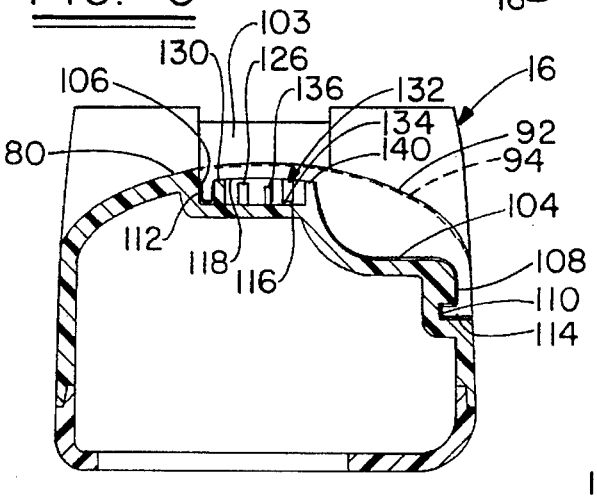
FIG. 11 is a cross-sectional elevational view through the nozzle taken at the latch illustrating the latch mounting arrangement therefor.
Figure 7:
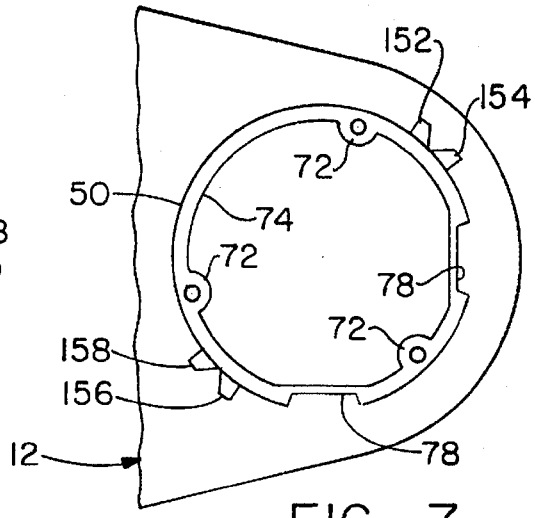
FIG. 7 is a bottom view of the front portion of the front housing of the hand held cleaner showing its stops and without the mounting ring.

To streamline the outline of the latch 76 and prevent inadvertent operation of it or operator injury, the latch 76 is given an external latch outline 92 in end view (FIG. 11) that conforms to a crowned transverse outline 94 of swiveling nozzle 16. The latch 76 also conforms along its axial length to the curvature of swiveling nozzle 16 (FIG. 1). Thus, with the latch 76 disposed in peripheral depression 82 the outer upper nozzle outline is fairly continuous.

The latch 76 includes an indented finger hold 96 that has in inset finger contacting portion 98 bordered by a right angled wall 100 that smoothly curves meldingly into the finger contacting portion 98 and also is somewhat curvilinear to the remainder of the latch 76. The right angled wall 100 is surmounted by a linearly extending latch continuing portion 102 which melds with the swiveling nozzle outline.

Inwardly of the finger hold 96 in both the longitudinal and transverse direction of the swiveling nozzle 16, the latch continuing port 102 extends towards the front housing depending boss 50. This section is stepped upwardly at its inner end 103 in a slightly curvilinear manner to locate the integral inner latch catch 88 at a proper height to latchingly selectively engage in one the latch receiving pockets 78, 78.

The peripheral depression 82 that receives the latch 76 has a bottom surface 104 of its leg 82 curved inwardly to conform and receive the curved finger hold 96 so that it may smoothly guide the latch 76 in its reciprocating motion. Inwardly of this surface, is a substantially parallel straight sided, top horizontally opening upper guiding slot 106 that extends linearly along the swivel nozzle 16 to aid in guiding movement of the latch 76 along swivel nozzle 16. Also, below the finger contacting portion 98 of the finger hold 96 is a curvilinear, vertical continuation of the indented finger hold 96 which forms a vertical wall 108 of the latch 76. The nozzle 16 also has a lower guidance slot 110 in it adjacent the bottom part of vertical wall 108 that is parallel to the upper guiding slot 106. These two slots serve to guide the latch 76 in its reciprocating movement.

To this end, the latch 76 includes a pair of tangs 112, 114 that engage, respectively, in the upper and lower guiding slots 106, 110 in swiveling nozzle 16. To mount the latch 76 in the depression 82, the upper tang 112 of the latch is mounted in its upper slot 106 and then the latch 76 is pivoted downwardly until the lower tang 114 levers over the edge of the slot 110 to be fully received therein. The latch 76 is then resiliently held securely by its two engaging tangs 112, 114 to maintain it slidingly and reciprocatorily within the swivelling nozzle 16.

Figure 6:
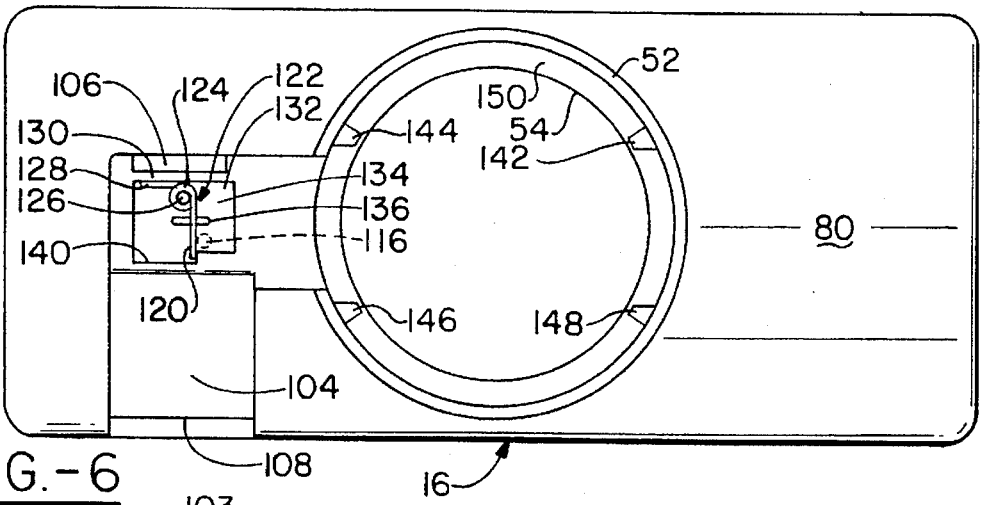
FIG. 6 is a top plan view of the nozzle.

The latch 76 is continuously urged into latched position with the latch catch 88, selectively, disposed within one of the latch receiving pockets 78, 78. This is occasioned by the latch 76 including a downwardly extending pin 116 mounted on a bottom side 118 of it. The pin 116 receives an urging end 120 of a torsion spring 122 in abutment against it. The spring is mounted with its coil 124 disposed over a second pin 126 that is integral with the top surface of swiveling nozzle 16 by extending from a bottom surface 134 of an inset 132 of swiveling nozzle 16. The other end 128 of the torsion spring 122 reacts against an adjacent wall 130 of the swiveling nozzle 16. This wall forms one of the borders of the inset 132 formed in the top side of the swiveling nozzle 16. Also, a short spacing wall 136 extends from this same bottom surface, with the spacing wall 131 maintaining the torsion spring 122 above the bottom surface 134 to prevent interference between it and the torsion spring 122. The torsion spring 122, by its latch contacting end 120, moves between the full line position of FIG. 6 when the latch 76 is engaged to the dashed line position in FIG. 10 when the latch 76 is disengaged. When the indented finger hold 96 of the latch is moved in a direction away from the boss 50 of front housing 12 (latch disengaged position), the latch is limited in outward movement by the outward engagement of the vertical side of the peripheral latch receiving depression 82 by the leg 86 of latch 76. Inward spring urged movement of the latch 76 is limited by spring end 120 engaging against a notch 138 formed in another vertical wall 140 of indent 132, disposed opposite to the vertical wall 130 of this same inset.

In order to positive locate the latch 76 relative to, selectively, one of the latch receiving pockets 78, 78, a series of circumferentially spaced, upwardly extending stops 142, 144, 146 and 148 are integrally formed on top side 150 of swiveling nozzle lip 54 that extend vertically away from this surface to provide short upstanding stub-like projections. These stops are flat on their engaging side, while angled on their opposite sides to provide more structural integrity. The stops 142, 146 are diametrically opposite as are the stops 144, 148.

The stops 142, 144, 146 and 148 functionally interengage with short depending stub-like projecting stops 152, 154, 156 and 158. These stops are integral with the front housing 12 and extend vertically downwardly from the flat 58 of the front housing 12. These stops are shaped like the stops on the swiveling nozzle but are provided in much more closely arrayed diametrical pairs.

Figure 8:
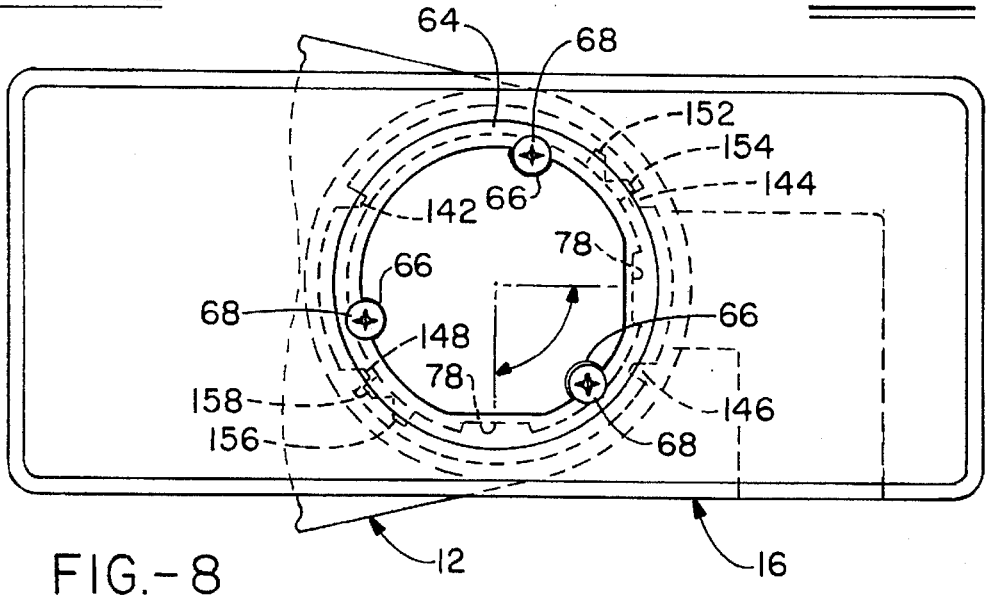
FIG. 8 is a view looking upwardly into the nozzle after it has been affixed to the cleaner front housing illustrating one of the stop and latching positions between the two.

The swiveling nozzle stops 144 and 148 engage the front housing nozzle stops 154, 158 (FIG. 8) when the swiveling nozzle 16 is in its normal position of operation with the contiguous flats of these stops abutting. The swiveling nozzle stops 142, 146 engage the front housing nozzle stops 152, 156 when the swiveling nozzle 16 is perpendicular relative to the front housing 12. The swiveling nozzle 16 is thereby positively limited in its swing between its two operative cleaning positions by interengagement of the various stops on the swiveling nozzle 16 and front housing 12. Obviously, at these limits of travel, one or the other latching pockets 78, 78 is aligned with the latch 76 which is automatically resiliently urged into latching position by torsion spring 122.

The swiveling nozzle 16 includes a driven, brushed agitator 160 that is rotatably mounted in the swiveling nozzle 16 by capped bearing pieces 162, 162 that carry sleeve bearings 163, 163 which rotatably support shafts 165, 165 pressed fast with driven agitator 160. However, any conventional bearing arrangement located at each end of the agitator 160 would suffice. The agitator 160 is belt driven by a belt 164 that is trained over a motor shaft 166 and a crowned pulley 168 formed on the agitator 160 intermediate its bearing cap ends. The belt 164 is conventionally twisted to drive the agitator 160 when it is in its normal position (FIG. 2) and untwisted (FIG. 1) when the swiveling nozzle 16 is axially aligned with the front housing 12.

The crown pulley 168 (FIG. 2) has a center line 170 which is offset, from the rear, to the right of a transverse center line 172 of the agitator. This centers the belt 164, for effective drive, on the crown pulley in its normal twisted position since this is position on which it naturally settles. When the belt 164 is in its untwisted agitator driving position this offset is easily accommodated by slight belt extension. In the hand held cleaner in question, this offset is 0.157 inches.

The agitator 160 also has an axially extending center line 174 that is offset forwardly from a rotational center 176 of the boss-like portion 48 of swiveling nozzle 16 mounted on the boss 50 of front housing 12. This provides additional space behind the brushed agitator 160 in its conventional position for the passage of dirty air therebehind into the suction passageway 30. It also, moreover, limits belt movement on its motor driving shaft so the belt does not disengage from this shaft when twisted. This offset was set at 0.250 inches for the hand held cleaner 10.

The outline of swiveling nozzle 16 generally is completed by the mounting of a bottom plate 178 on it which may, e.g., be screwingly attached thereto through screw bosses 180, 180 at its rear and clip mounted over a one-way dart at its front (not shown).

It should be clear from the foregoing description of the invention that all the objects set out for it have been fully satisfied. It should also be obvious that many modifications could be made to the invention as described which would still fall within its spirit and purview. For example, the nozzle 16 could be latched at differing swung positions or at more swung positions such as is taught in U.S. application Ser. No. 29/044,847, filed on 2 Oct. 1995 and owned by a common assignee.

What is claimed is:

1. A hand held cleaner including:

a) a front housing;

b) a swivelable nozzle pivotally attached to a bottom portion of said front housing;

c) a latch mounted on said swivelable nozzle for solely axial reciprocating movement therealong; and d) at least one latch aperture in said bottom portion of said front housing.

2. The hand held cleaner of claim 1 wherein:

a) said bottom portion of said front housing includes at least two latch apertures;

b) said latch apertures having positions disposed at least 90° from each other; and c) said swivelable nozzle pivoting on said bottom portion of said front housing between said latch aperture positions so that is may assume nozzle positions which are disposed at least 90° from one another.

3. The hand held cleaner of claim 2 wherein:

a) said latch includes a finger engaging portion for ease in operator manipulation.

4. The hand held cleaner of claim 2 wherein:

a) said latch includes a pair of upper and lower engaging tabs;

b) said swivelable nozzle includes a pair of upper and lower spaced guiding slots extending axially along said swivable nozzle; and c) said engaging tabs received within said slots to mount said latch to said swivelable nozzle.

5. The hand held cleaner of claim 4 wherein:

a) said latch is somewhat curvilinear in cross-sectional shape between said tabs; and b) said curvilinear shape is resiliently deformed slightly when said latch is mounted on said swivelable nozzle to thereby maintain said tabs elastically in said guidance slots and said latch fast with said swivable nozzle.

6. A hand held cleaner as set out in claim 2 wherein:

a) a series of stops are mounted on said bottom portion of said front housing;

b) a series of stops are mounted on a top portion of said nozzle; and c) at least two of said stops mounted on the top portion of said nozzle engage at least two of said stops mounted on the bottom portion of said front housing when said swivelable nozzle is disposed in either of its said positions.

7. A hand held cleaner according to claim 1 wherein said pivotal attachment of said swivelable nozzle to said front housing is formed by:

a) a depending boss-like portion on said front housing;

b) an upwardly extending boss on said swivelable nozzle;

c) one of said boss-like portion and said boss telescopically and rotatably received with the other; and (d) a mounting ring mountingly attached to one of said boss-like portion and said boss to overlap a lip on the other to thereby maintain their telescopic and rotatable assembly.

8. A hand held cleaner and its pivotal attachment according to claim 7 wherein:

a) said bottom portion of said front housing includes depending stops;

b) said boss on said swivelable nozzle includes upwardly extending stops; and c) at least one of said upwardly extending stops engaging at least one of said depending stops to thereby limit nozzle pivoting.

9. A hand held cleaner including:

a) a rotatably driven brush agitator;

b) a belt driving said agitator;

c) a rotating motor shaft for driving said belt;

d) a crown pulley on said rotatably driven brush agitator, fast with said agitator and receiving said belt to thereby drive said agitator;

e) a vertical center line of said crown pulley being offset from a vertical center line of said agitator;

f) said rotatably driven brush agitator being mounted for such rotation in a nozzle of said hand held cleaner;

g) said hand held cleaner having a body and said nozzle being swivelably mounted to swing about said body of said hand held cleaner on a substantially vertical axis;

h) whereby said belt twists during swinging movement of said nozzle and said crown offset accommodates such swing so that said belt rends to center on said crown.

10. A hand held cleaner including:

a) a rotatably driven agitator;

b) a nozzle rotatably mounting said agitator;

c) said rotatable agitator having an axial center line;

d) said nozzle being pivotally attached to a housing portion of said hand held cleaner on a pivot having a generally vertical axis;

e) said rotatable agitator having a horizontally extending axis; and f) said generally vertical axis of said pivot being transversely offset relative to said horizontally extending axis of said agitator.

11. A hand held cleaner including:

a) a rotatably driven brush agitator;

b) a belt driving said agitator;

c) a rotating motor shaft for driving said belt;

d) a crown pulley fixed on said agitator and receiving said belt to thereby drive said agitator;

e) said crown pulley having a vertical center line;

f) said motor shaft having a vertical center line;

g) one of said center lines being offset relative to the other of said center lines;

h) said hand held cleaner including a body;

i) said agitator being mounted to swivel relative to said body;

j) whereby twist of said belt upon swiveling of said agitator is accommodated by said offset.

* * * * *